US005122626A

United States Patent [19]

Shinohara et al.

[11] Patent Number: 5,122,626

[45] Date of Patent: Jun. 16, 1992

[54] ILLUMINATED DISPLAY PUSH-BUTTON SWITCH

[75] Inventors: Kenji Shinohara, Ibaraki; Takashi Niwa; Norio Iwakiri, both of Kyoto, all of Japan

[73] Assignee: Omron Tateishi Electronics Co., Kyoto, Japan

[21] Appl. No.: 704,848

[22] Filed: May 20, 1991

Related U.S. Application Data

[63] Continuation of Ser. No. 532,124, Jun. 4, 1990, abandoned, which is a continuation of Ser. No. 177,355, Apr. 1, 1988, abandoned.

[30] Foreign Application Priority Data

Apr. 1, 1987 [JP] Japan ..... 62-50297[U]

[51] Int. Cl.[5] ..... H01H 5/06; H01H 5/10

[52] U.S. Cl. ..... 200/457; 200/458; 200/332; 200/314

[58] Field of Search ..... 200/457, 458, 303, 314, 200/293, 332, 332.1, 330, 329, 454, 453

[56] References Cited

U.S. PATENT DOCUMENTS

| | | | |
|---|---|---|---|
| 2,755,353 | 7/1956 | Bachi | 200/457 |
| 2,924,692 | 2/1960 | Campe | 200/167 |
| 3,176,105 | 3/1965 | Hallerberg | 200/528 |
| 3,277,264 | 10/1966 | Barthell | 200/525 |
| 3,495,058 | 2/1970 | Davy | 200/457 |
| 3,755,642 | 8/1973 | Warner | 200/332 |
| 3,803,342 | 4/1974 | Stearley | 174/59 |
| 4,200,773 | 4/1980 | Komatsu et al. | 200/303 |
| 4,354,078 | 10/1982 | Yoshimura | 200/314 |
| 4,453,062 | 6/1984 | Brown et al. | 200/332 X |
| 4,692,572 | 9/1987 | Heath | 200/457 |

FOREIGN PATENT DOCUMENTS

| | | | |
|---|---|---|---|
| 1102864 | 1/1957 | Fed. Rep. of Germany | 200/303 |
| 1359716 | 2/1963 | France . | |
| 56-34334 | 8/1981 | Japan . | |

*Primary Examiner*—Renee S. Luebke
*Assistant Examiner*—David J. Wolczak
*Attorney, Agent, or Firm*—Fish & Richardson

[57] ABSTRACT

In a push-button switch in which a switch mechanism switched over on the basis of push-button depression is supported between a pair of split-type switch bases so as to be switchably operated, a falling-off prevention engage portion is formed at an end of a lever pivotal axle of a inclination lever provided for the switch mechanism, so as to be engageable with a pivotal hole formed in an opposing side wall of the switch base for prevention of falling-off of the inclination lever from the switch base.

5 Claims, 6 Drawing Sheets

11
18
20
21
14
48
31
32
19
22
23
49
17
12
27a
24
27
52
26
28
43a
47
28a
25
46
28
50
25a
36
36b
16
29
39
42
36a
36b
38
33
40
43
13
30
45
46
37
44
51
41
15
34
35

ILLUMINATED DISPLAY PUSH-BUTTON SWITCH

REFERENCE TO RELATED APPLICATION

This application is a continuation of U.S. application Ser. No. 07/532,124, filed Jun. 4, 1990, now abandoned, which is a continuation of U.S. application Ser. No. 07/177,355, filed Apr. 1, 1988, now abandoned.

This application is related to commonly-assigned Ser. No. 169,907, filed Mar. 16, 1988, which discloses aspects of the invention disclosed herein.

BACKGROUND OF THE INVENTION

1. Field of the Invention

The present invention relates to a push-button switch arranged on the front surface of, for example, an automatic ticket machine used at a railway station, and more specifically to a push-button switch whose switch mechanism may be assembled at high rates of productivity.

2. Description of the Prior Art

In recent push-button switches, various levers or various lever return springs are assembled inside the push-button switch in order to stabilize switching operation and to improve tactile feeling.

In the prior-art push-button switches, however, there exist problems in that the assembly work is troublesome and therefore takes much time and many process steps or needs many fixing jigs in the course of production. The reasons are as follows: when various levers are assembled, since support axles of each lever are fitted to support holes formed on two opposing sides of a split-type switch base and further a lever return spring is assembled under spring compression conditions, there exists a problem in that the levers and the springs must be supported by jigs so that these parts do not jump away and can be assembled stably by locating these parts at appropriate positions.

SUMMARY OF THE INVENTION

With these problems in mind, therefore, it is the primary object of the present invention to provide a push-button switch of high assembly productivity, in which the switch mechanism can easily be assembled between two switch bases.

To achieve the above-mentioned object, the push-button switch of the present invention is characterized in that pivotal recessed engagement holes are formed on both opposing side walls of a split-type switch base and further a fall out prevention engagement portion is formed at an end of a lever support axle of an inclination lever.

According to the present invention, in the assembly of the switch mechanism, the inclination lever is temporarily assembled at a predetermined position without falling out, by fitting the fall-out prevention portion of an end of the inclination lever to the pivotal support hole formed in the switch base. Under these temporary assembling conditions, the levers and return springs of the switch mechanism, for example, are easily positioned for assembly.

Therefore, the levers will not be dislocated or fall-out and the return springs can be attached stably, so that it is possible to accurately position parts and therefore to improve the assembly precision.

Further, since temporary assembly can be achieved, it is possible to simplify and therefore reduce the assembly work. On the other hand, it is possible to provide a reliable switch excellent in assembly and disassembly productivity.

The other features of the present invention will be clarified by the following description of a preferred embodiment with reference to the attached drawings.

DETAILED DESCRIPTION OF THE PREFERRED EMBODIMENTS

Figure 1:
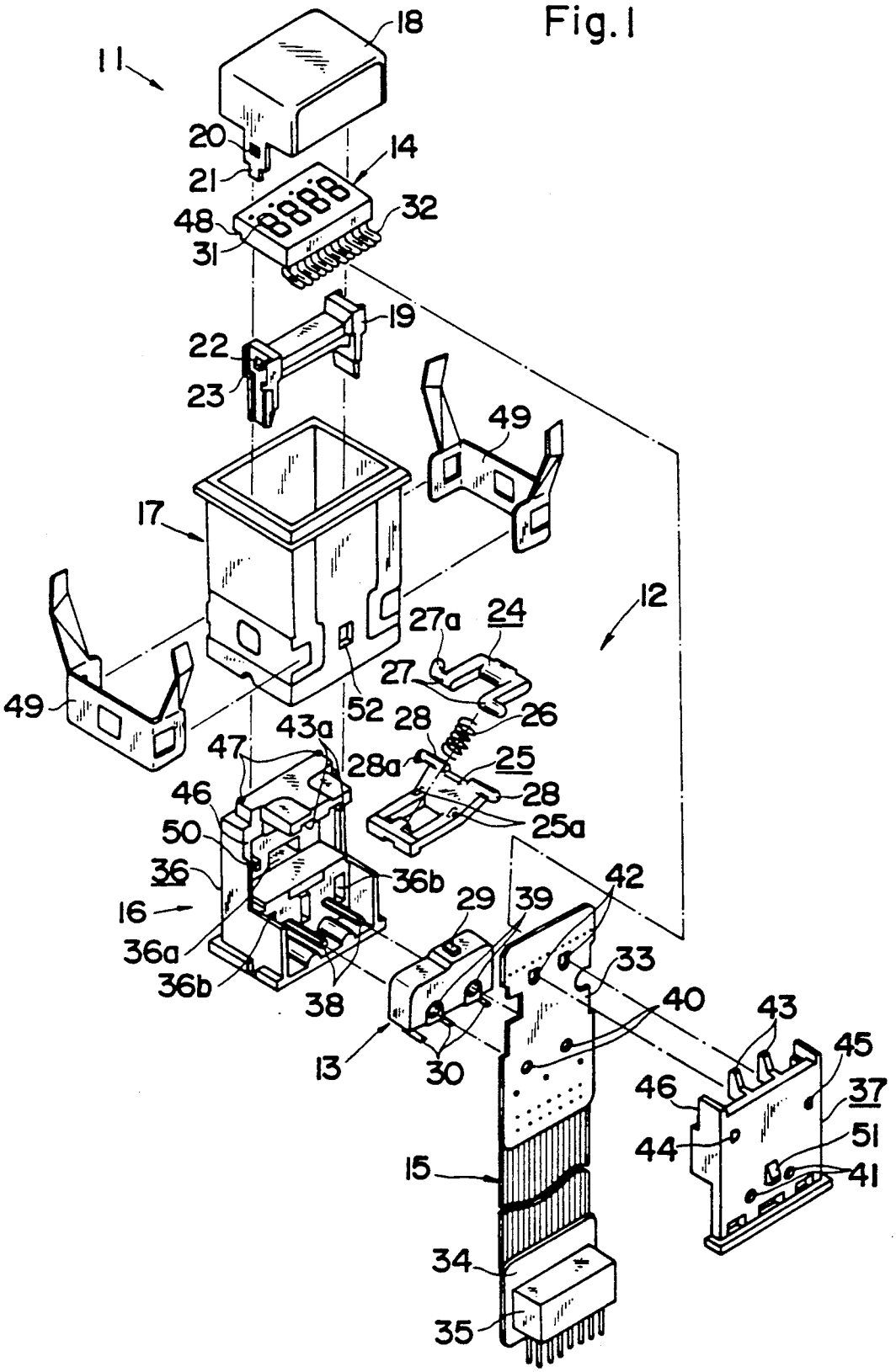
FIG. 1 is an exploded view showing an illumination display type push-button switch.
Figure 2:
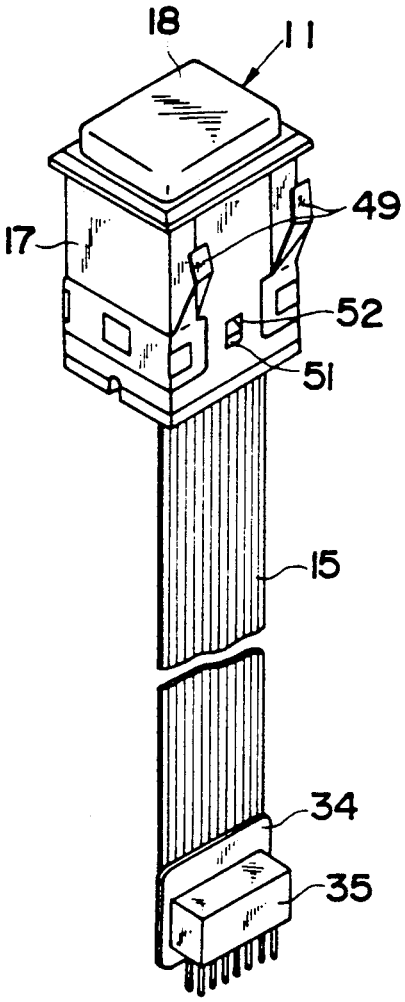
FIG. 2 is an external perspective view of the illumination display type push-button switch.
Figure 3:
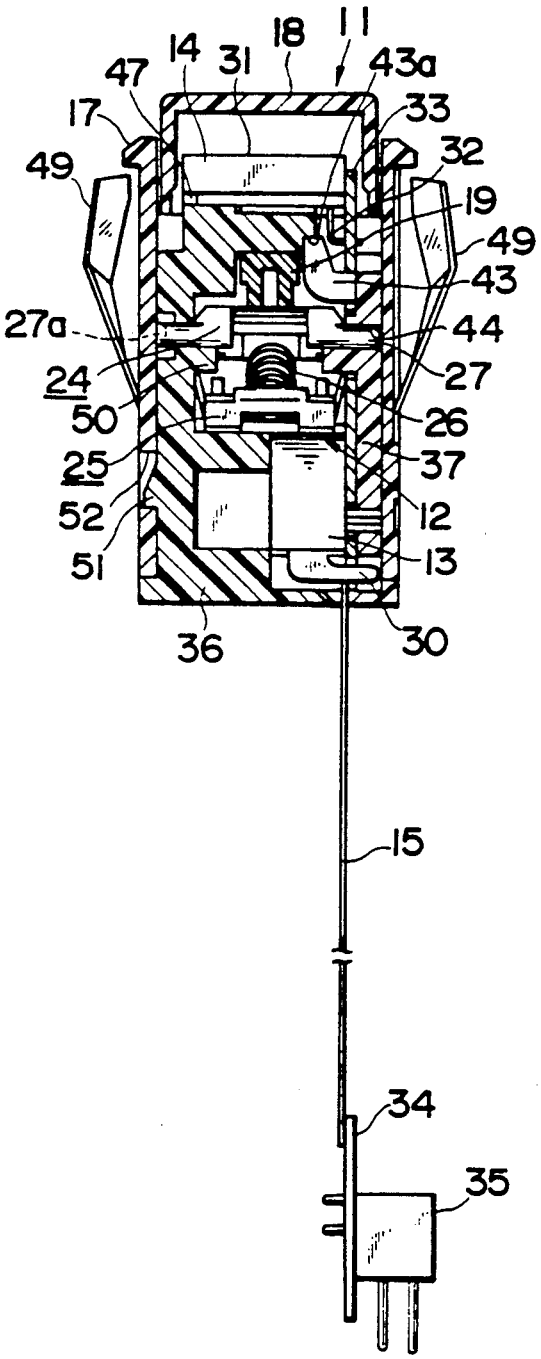
FIG. 3 is a front longitudinal cross-sectional view of the illumination display type push-button switch.
Figure 4:
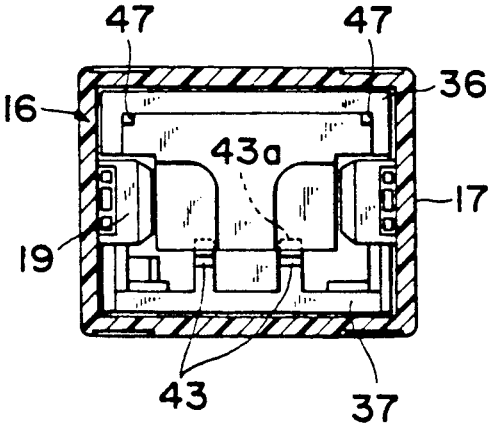
FIG. 4 is a side lateral cross-sectional view of the illumination display type push-button switch.

An embodiment of the present invention will be described in detail hereinbelow with reference to the attached drawings which show an illumination display type push-button switch.

In FIGS. 1 to 6, this illumination display type push-button switch comprises roughly a push-button unit 11, a switch mechanism 12, a microswitch 13, a flexible board 15, a switch base unit 16 and a switch case 17.

The above push-button unit 11 is provided with a push button 18 and a push-button slide member 19 for guiding the downward motion of this push-button 18. This push-button 18 is made of a resin material and formed into a box shape having a light transmissible upper surface and an open bottom, in which a display unit 14 described later is housed. Further, the push-button unit 11 is formed with downward extending stepped tabs 21, each of which has an engagement hole 20 at the middle thereof, on both side walls thereof, respectively. To these two stepped tabs 21, the push-button slide member 19 is fitted as described below.

The push-button slide member 19 is formed into a gate shape and with two engagement projections 22 fittable to the engagement holes 20 and a stepped tab support portions 23 to which the stepped tabs 21 are fitted, respectively on both outer sides thereof. Therefore, the push-button slide member 19 is coupled with the push-button 18 by fitting the two stepped tabs 21 to the two stepped tab support portions 23. Further, under these coupled conditions, the middle lower surface of the push-button slide member 19 is opposed to the switch mechanism 12 arranged under the push-button unit 11.

The switch mechanism 12 is composed of a first inclination lever 24, a second inclination lever 25 and a lever return spring 26. The first inclination lever 24 is formed into U-shape and with two first pivotal axles 27 bent on both the ends thereof outwardly at right angles. These axles 27 are pivotally supported by the switch base unit 16 described later. Further, the upper end of the first inclination lever 24 is opposed to the middle lower surface of the push-button slide member 19.

The second inclination lever 25 is formed into a dog-legged shape and with two second pivotal axles 28 projected on both upper ends thereof outwardly. These axles 28 are pivotally supported by the switch base unit 16. Further, the middle lower dogleg-bent portion is opposed to an actuator 29 of the microswitch 13 so as to be brought into contact with or separated away from the actuator 29.

Further, a coil return spring 26 is disposed under compression between the inner middle surface of the first inclination lever 24 and the inner middle surface at the lower end of the second inclination lever 25. Therefore, the first inclination lever 24 disposed over the second inclination lever 25 is urged upward with the pivotal axles as its center, so as to urge and move the push-button slide member 19 and the push button 18 in the upward direction. On the other hand, the second inclination lever 25 disposed below the first inclination lever 24 is urged by the lever return spring 26 to urge the actuator 29 of the microswitch 13 in the downward direction. In these conditions, the microswitch 13 is kept turned off.

When the push-button 18 is depressed, the first inclination lever 24 is pushed downward via the push-button slide member 19, so that the lever return spring 26 is compressed gradually. When this spring urging pressure increase at a predetermined downward position of the push-button 18, the second inclination lever 25 is reversely turned over quickly with the pivotal axles as its center. Since the second inclination lever 25 is separated away from the actuator 29 of the microswitch 13, the actuator 29 is allowed to move in the upward direction. Under these conditions, the microswitch 13 is kept turned on.

Figure 7:
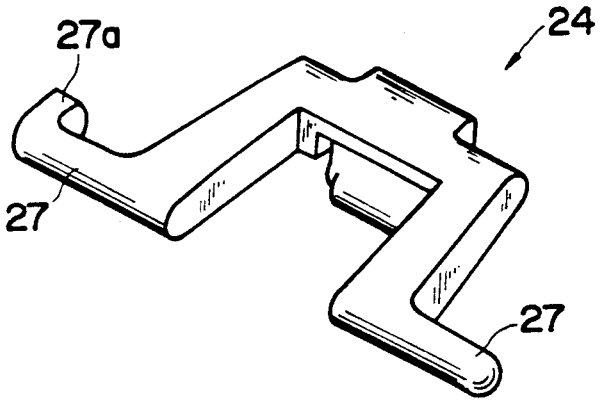
FIG. 7 is a perspective view showing a first inclination lever.
Figure 8:
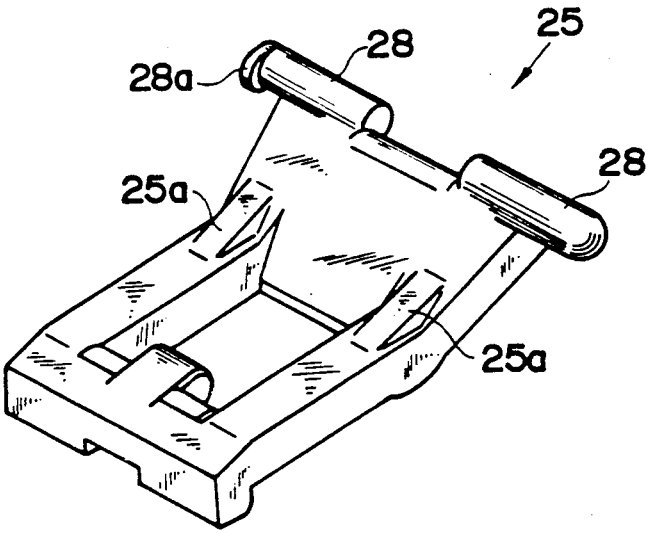
FIG. 8 is a perspective view showing a second inclination lever.

As shown in FIGS. 7 and 8, one of the two pivotal axles 27 projecting from both sides of the first inclination lever 24 is formed with a fall-out prevention engagement portion 27*a* bent at right angles with respect to the axial direction so as to be fittable to a recessed portion 44*a* of a pivotal hole 44, described below, formed in the switch unit base 16. Similarly, one of the two pivotal axles 28 projecting from both sides of the second inclination lever 25 is formed with a fall-out prevention engagement portion 28*a* bent at right angles with respect in the axial direction so as to be fittable to a recessed portion 45*a* of a pivotal hole 45 formed in the switch unit base 16.

Therefore, when the first and second inclination levers 24 and 25 are assembled with the switch unit base 16, these two levers can be supported temporarily at the predetermined positions by engaging the two best fall-out prevention engagement portions 27*a* and 28*a* with the recessed portions of the pivotal holes formed in the switch unit base. Under these temporary assembly conditions, the other end 27 or 28 of the first or second inclination lever 24 or 25 is easily positioned at a predetermined location together with the lever return spring 26.

Further, the second inclination lever 25 is formed with a pair of reinforcement ribs 25*a* on the inner bent portion of this dog-legged lever 25. Therefore, when a downward force is applied by the push-button 18 to this second inclination lever 25 during switching action, these reinforcement ribs 25*a* increase the resistance against elongation or deformation, thus improving the stability of the switching action.

The above-mentioned microswitch 13 is provided with an actuator 29 coming into or from the microswitch body on the basis of the pivotal movement of the second inclination lever 25. On the lower surface of the microswitch 13, L-shaped external terminals 30 are provided so as to extend from one side thereof. These terminals 30 are connected to a fixed board 33 coupled to the flexible board 15 described later.

The display unit 14 is provided with a display surface 31 on which 7-segment digit display units are arranged in such a way as to be opposed to the lower recessed portion of the push-button 18. When this push-button 18 is depressed for information input operation, the inputted information is illuminated and displayed. On the other hand, a number of L-shaped external terminals 32 are provided so as to extend from one side thereof. These terminals 32 are connected to the fixing board 33 coupled to the flexible board 15 described later.

The above flexible board 15 is a flexible tape on which input and output conductors are arranged. This flexible board 15 and the flat fixing board 33 having the same width as the flexible board 15 are put together. The display unit 14 is connected to the upper portion of the fixing board 33 via the external terminals 32, while the microswitch 13 is connected to the lower portion thereof via the external terminals 30, respectively. Therefore, the display unit 14 and the microswitch 30 are connected to corresponding conductors arranged on the flexible board 15.

In this embodiment, since the flexible board 15 can be simply connected to the reinforcing fixing board 33 by putting the inner connecting portion of the flexible board 15 on the fixing board 33 on the same surface, it is unnecessary to bend the inner connecting portion of the flexible board 15 when connecting the microswitch 13 and the display unit 14 to the flexible board 15. Therefore, it is possible to minimize the space within the switch casing required for connection (when the flexible board connecting portion is bent for connection, a broader space is required), so that the switch can be minimized in shape.

In particular, since the switch 13 and the display unit 14 are mounted on the fixing board 33, it is possible to simplify the internal structure and to locate these parts accurately via the fixing board 33, thus realizing precise assembly.

Further, a connector 35 for connecting external conductors is connected to the outer connecting portion of the flexible board 15 via a connector board 34.

The above switch base unit 16 is composed of a first base 36 and a second base 37 and is formed into a box shape by combining the two bases 36 and 37. When these two bases 36 and 37 are combined, a pair of projecting switch support rods 38 formed on the opposing side wall of the first base 36 is passed through two locating holes 39 formed in the microswitch 13, two board holes 40 formed in the fixing board 33 and two fixing holes 41 formed in the second base 37, in sequence, in order to fix the fixing board 33 or the flexible board 15. In this assembly step, a pair of L-shaped engagement projections 43 formed on the upper opposing wall of the second base 37 is passed through a pair of engagement holes 42 formed at the upper portion of the fixing board 33 and further fitted to a pair of engagement recesses 43*a* formed on the opposing wall of the first base 36, so that the fixing board 33 is sandwiched between the two bases 36 and 37 after the two bases are assembled.

Further, it is possible to accurately position and couple both the bases 36 and 37 by depending upon these engagement projections 43 and the engagement recesses 43*a* to maintain the alignment of the parts.

The switch mechanism 12 composed of two inclination lever 24 and 25 to actuate the microswitch 13 is supported in an inner space formed between the two bases 36 and 37. The two bases 36 and 37 are formed, respectively, with first pivotal holes 44 for supporting the first pivotal axles 27 of the first inclination lever 24 and second pivotal holes 45 for supporting the second pivotal axles 28 of the second inclination lever 25.

Figure 9:
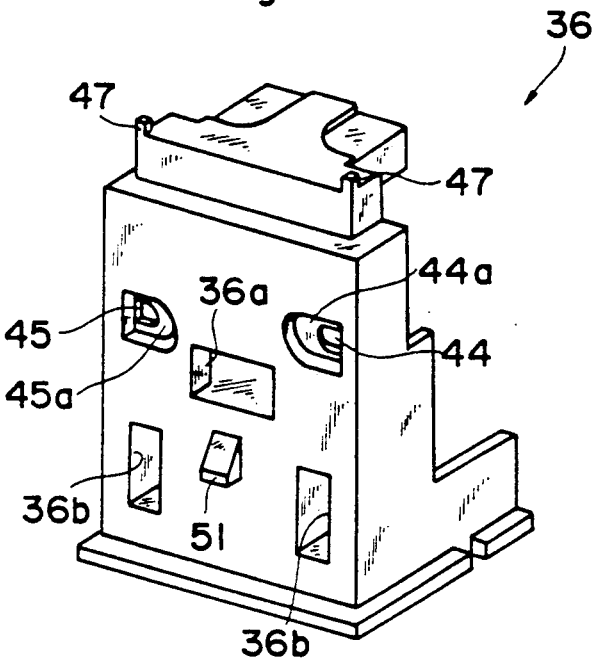
FIG. 9 is a perspective view of a first base.

As depicted in FIG. 9, the pivotal holes 44 and 45 formed in the first base 36 are formed with fall-out prevention recessed surface 44*a* and 45*a* so as to be fittable to the bent fall-out prevention engagement portions 27*a* and 28*a* of the inclination 24 and 25, respectively. When the two inclination levers 24 and 25 are temporarily assembled, these two recessed surfaces 44*a* and 45*a* serve to temporarily support these two levers 24 and 25.

On the other hand, two vertical guide grooves 46 are formed on both outer side surfaces of each of the two bases 36 and 37 in order to slidably support the stepped tab support portion 23 of the button slide member 19. Therefore, the downward movement of the push-button 18 is restricted via the push-button guide members 19 in order to eliminate an undesired play of the push-button 18.

In addition, a pair of projections 47 for fixing the display unit 14 are formed on the upper end of the first base 36 so as to be fitted to a pair of recessed portions 48 formed on both the lower surface corners of the display unit 14.

Figure 10:
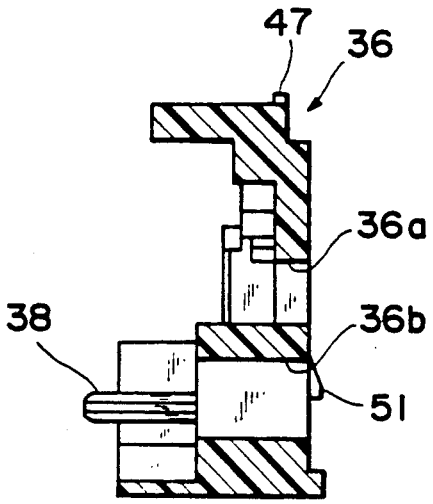
FIG. 10 is a longitudinal cross-sectional view showing the first base.

As depicted in FIGS. 9 and 10, the first base 36 is formed with a switching action inspection window 36*a* at the middle portion of the side wall thereof, through which the switch mechanism 12 arranged inside the base 36 can be inspected. Therefore, it is possible to confirm the snap movement or snap action of the switch mechanism 12 through this switch action inspection window 36*a*.

Further, the first base 36 is formed with a pair of base removal windows 36*b* on the side wall surface thereof and near the switch support rods 38 projecting from the inner surface of the first base 36. Therefore, the two first and second bases 36 and 37 can be separated easily when two ends of a base removal jig (not shown) are inserted into these base removal windows 36*b* to urge the second base 37 away from the first base 36.

This removal of the first and second bases is required when it is necessary to reassemble the switch mechanism 12 due to maloperation. In doing this, the jig is inserted into the two windows 36*b* located near the switch support rods 38 in order to effectively urge the side surface of the microswitch 13 mounted on the fixing board 33 away from the first base 36 together with the fixing board 33 and the second base 37.

The switch base unit 16 assembled into a box shape is covered with a hollow square pillar-shaped switch casing 17 in order to cover the windows 36*a* and 36*b* formed in the base 36, that is, to protect the switch from external dust or light, thus permitting stable switch function.

Further, a pair of leaf spring plates 49 is fitted to the outside of the switch case in order to fix this push-button switch to a device.

In order to obtain a sufficient switch stroke of the push-button 18, the inclination angle of the first inclination lever 24 of the switch mechanism 12 is set at a predetermined angle to correspond to the downward stroke of the push-button 18. Further, the upward movement stroke of the second inclination lever 25 obtained whenever it is turned over is restricted by a lever stopper projection 50 formed inside the first base 36.

In the drawing, the reference numeral 51 denotes a case stopper projection formed in the second base 37 and 52 denotes a case stopper hole formed in the switch case 17.

The operation of the illumination display type push-button switch will be explained hereinbelow.

Figure 5:
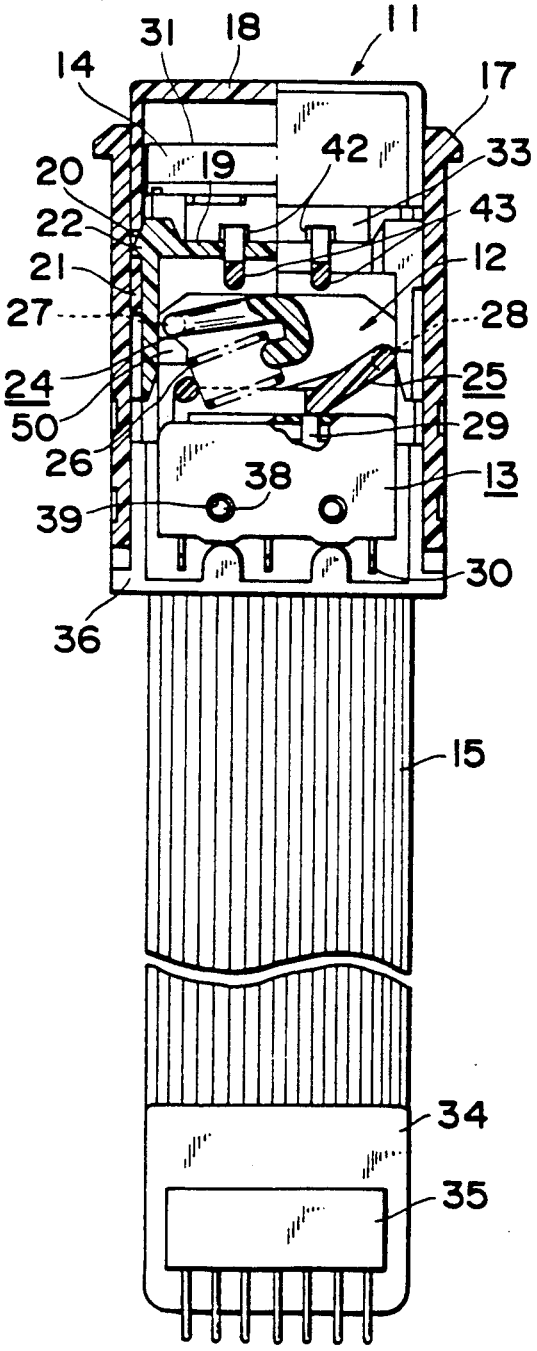
FIG. 5 is a side longitudinal cross-sectional view showing an OFF state of the illumination display type push-botton switch.

In usual operation, the push-button 18 is turned off in such a way as to project by a predetermined distance from the upper surface of the switch case 17 by the urging force of the internal lever return spring 26, as shown in FIG. 5.

Figure 6:
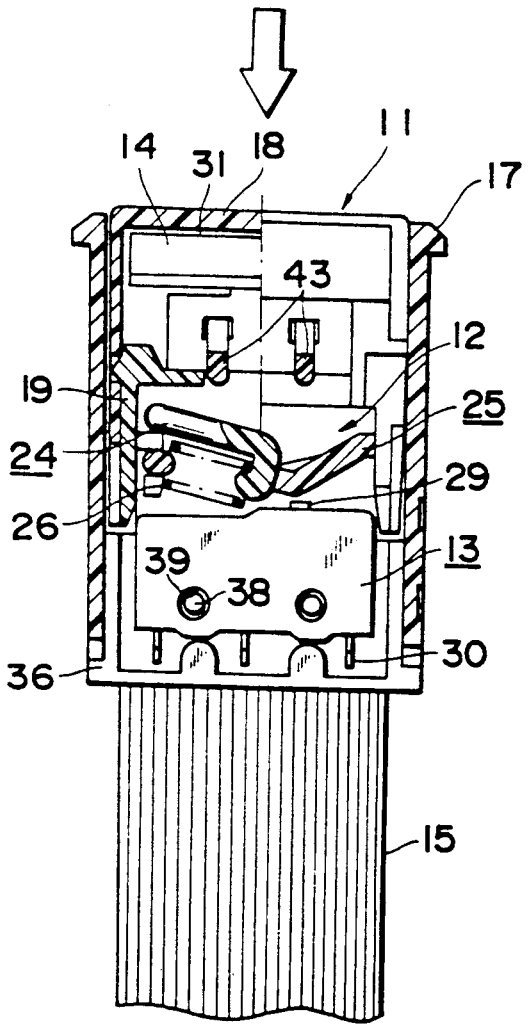
FIG. 6 is a side longitudinal cross-sectional view showing an on state of the illumination display type push-button switch.

When the push-button 18 is depressed, as shown in FIG. 6, the push-button slide member 19 coupled to the push-button 18 is guided downward along the guide grooves 46 formed in the switch base unit 16, so that the middle portion of the push-button member 19 moves down the free end of the first inclination lever 24. When the free end of the first inclination lever 24 is being moved downward, the lever return spring 26 first absorbs the above downward movement or load. However, when the downward movement exceeds a predetermined value, the free end of the second inclination lever 25 is reversely inclined upward by the lever return spring 26. This reverse inclination motion provides a good switching operation with a click feeling different from that of the microswitch itself. Further, this reverse inclination motion separates the second inclination lever 25 away from the actuator 29 of this microswitch 13, so that the actuator 29 is moved upward to turn on the microswitch 13. In response to this microswitch turn-on operation, necessary information is illuminated or displayed on the illumination display 14.

When the push-button 18 is released from the depression, the switch mechanism 12 is returned to its original position.

In assembling the above switch mechanism 12, first the pivotal axles 27 and 28 of the first and second inclination levers 24 and 25 are inserted into the first and second pivotal holes 44 and 45 formed in the first base 36. In this step, since the fall-out prevention engagement portions 27*a* and 28*a* projecting from the pivotal axles 27 and 28 are engaged with the fall-out prevention engagement recessed surfaces 44*a* and 45*a* of the pivotal holes 44 and 45, these two inclination levers 24 and 25 are temporarily assembled at predetermined positions so that they will not fall out of the assembly. Under this temporary assembling state, the two levers 24 and 25 and the lever return spring 26 can be assembled without the use of any special jigs, thus facilitating the assembling work.

As described above, since the switch mechanism 12 can be temporarily assembled, it is possible to simplify the assembly work of the switch mechanism in the entire switch assembly process, thus providing a highly reliable push-button switch of excellent assembly and disassembly characteristics.

To assemble the entire switch after the switch mechanism 12 has temporarily been assembled with the first base 36, the fixed board 33 on which the microswitch 13 and the display unit 14 are mounted is also assembled temporarily and finally the two engagement projections 43 of the second base 37 are engaged with the two engagement recesses 43*a* of the first base 36 after having passed through the two engagement holes 42 formed in the fixing board 33.

Under these conditions, a pair of the bases 36 and 37 is accurately positioned and assembled with the fixing board 33 sandwiched between the two bases. Further, the microswitch 13 and the display unit 14 are both accurately located, so that it is possible to obtain high assembly precision and therefore highly stable switching operation.

To confirm whether the switch mechanism 12 is correctly assembled within the switch unit base, it is possible to inspect the assembled switch mechanism 12 from the outside through the switch operation inspection windows 36*a* formed in the side wall of the first base 36. In case malfunction, the switch mechanism 12 is inspected. It is required as a result of the inspection to separate the bases, a jig is inserted through the base removal windows 36*b* to smoothly urge the second base 37 via the microswitch 30 to separate of the second base 37 from the first base 36.

As described above, through the switch operation inspection window, it is possible to inspect the internal switch mechanism from the outside for inspection of the positional relationship of the switch mechanism or the switching operation of the switch. In addition, it is possible to easily separate both the bases through the base removal windows without damaging or deforming the inner switch parts.

Further, since the switch and display unit housed in the switch casing are electrically connected to the flexible input/output conductor wiring board via the reinforcing fixing board, it is possible to connect the switch and the display unit to the flexible board without bending the connection portion of the flexible board, while keeping the flexible board flush with the fixing board. Therefore, it is possible to simplify the connection of the switch and the display unit to the flexible board without applying an overload to the flexible board, thus realizing highly stable connection work.

We claim:

1. A push-button switch comprising: a push button; a switch mechanism for generating on-off signals in response to depression of the push button; and a split-type base for supporting said switch mechanism;

said switch mechanism having an inclination lever formed with pivotal axles for pivotally supporting the inclination lever on said base, a return spring operatively connected with said inclination lever, and a switching element which is turned off and on when said inclination lever is inclined in response to a downward motion of said push button, wherein pivotal holes are formed on side walls of said base and a fall-out prevention engagement portion is formed on a pivotal axle portion of said inclination lever to be inserted into at least one of the pivotal holes;

a display unit disposed within said push button for displaying switching input information inputted through said push-button;

a fixing board for mounting said display unit and a switching element in said switching mechanism; and two base halves for constituting said split-type base to support said fixing board, a first base being formed with engagement portions engageable with parts of said display unit and first engagement recessed portions engageable with a second base half and the second base half being formed with engagement projections engageable with the first engagement recessed portions through engagement holes formed in said fixing board.

2. A push-button switch comprising: a push button; a switch mechanism for generating on-off signals in response to depression of the push button; and a split-type base for supporting said switch mechanism;

said switch mechanism having an inclination lever formed with pivotal axles for pivotally supporting the inclination lever on said base, a return spring operatively connected with said inclination lever, and a switching element which is turned off and on when said inclination lever is inclined in response to a downward motion of said push button, wherein pivotal holes are formed on side walls of said base and a fall-out prevention engagement portion is formed on a pivotal axle portion of said inclination lever to be inserted into at least one of the pivotal holes;

a display unit disposed within said push-button for displaying switching input information inputted through said push-button;

a fixing board for mounting said display unit and a switching element in said switching mechanism; and an input/output wiring flexible board which is coupled to said fixing board, which is electrically connected to said display unit and said switching element via said fixing board, and which extends toward the outside of the push-button switch.

3. A push-button switch comprising a push-button, a switch mechanism for generating on-off signals in response to depression of the push-button, and a base for supporting said switch mechanism, said switch mechanism having a first inclination lever formed with a pivotal axle for pivotally supporting the first inclination lever on said base and having a spring connecting mechanism, a second inclination lever having a pivotal axle for pivotally supporting the second inclination lever on said base, and having a spring connecting mechanism, and having a hole through a portion of said second inclination lever, a lever return spring disposed between said first and second inclination levers and operatively connected thereto at the spring connecting mechanism of the first inclination lever and the spring connecting mechanism of the second inclination lever, and a switching element which is turned off and on when said first inclination lever is inclined in response to a downward motion of said push-button, wherein the push-button switch is assembled so that when the push-button is depressed and the first inclination lever is pushed thereby, it pivots in a direction about the pivotal axle supporting said first inclination lever, and the lever return spring causes the second inclination lever to pivot about the pivotal axle supporting the second inclination lever in a direction opposite the direction in which said first inclination lever pivots, thereby causing a portion of the first inclination lever and a portion of the spring connecting mechanism of the first inclination lever to pass through the hole in the second inclination lever and separating the second inclination lever from an actuator on the switching element and causing the switching element to switch;

wherein pivotal holes are formed on side walls of said base and a fall-out prevention engagement portion projecting radially from an end of a pivotal axle portion of said first inclination lever is inserted into at least one of the pivotal holes.

4. A push-button switch comprising a push-button, a switch mechanism for generating on-off signals in response to depression of the push-button, and a base for supporting said switch mechanism, said switch mechanism having a first inclination lever formed with a pivotal axle for pivotally supporting the first inclination lever on said base and having a spring connecting mechanism, a second inclination lever having a pivotal axle for pivotally supporting the second inclination lever on said base, and having a spring connecting mechanism, and having a hole through a portion of said second inclination lever, a lever return spring disposed between said first and second inclination levers and operatively connected thereto at the spring connecting mechanism of the first inclination lever and the spring connecting mechanism of the second inclination lever, and a switching element which is turned off and on when said first inclination lever is inclined in response to a downward motion of said push-button, wherein the push-button switch is assembled so that when the push-button is depressed and the first inclination lever is pushed thereby, it pivots in a direction about the pivotal axle supporting said first inclination lever, and the lever return spring causes the second inclination lever to pivot about the pivotal axle supporting the second inclination lever in a direction opposite the direction in which said first inclination lever pivots, thereby causing a portion of the first inclination lever and a portion of the spring connecting mechanism of the first inclination lever to pass through the hole in the second inclination lever and separating the second inclination lever from an actuator on the switching element and causing the switching element to switch;

wherein pivotal holes are formed on side walls of said base and a fall-out prevention engagement portion projecting radially from an end of a pivotal axle portion of said second inclination lever is inserted into at least one of the pivotal holes.

5. A push-button switch comprising a push-button, a switch mechanism for generating on-off signals in response to depression of the push-button, and a base for supporting said switch mechanism, said switch mechanism having a first inclination lever formed with a pivotal axle for pivotally supporting the first inclination lever on said base and having a spring connecting mechanism, a second inclination lever having a pivotal axle for pivotally supporting the second inclination lever on said base, and having a spring connecting mechanism, and having a hole through a portion of said second inclination lever, a lever return spring disposed between said first and second inclination levers and operatively connected thereto at the spring connecting mechanism of the first inclination lever and the spring connecting mechanism of the second inclination lever, and a switching element which is turned off and on when said first inclination lever is inclined in response to a downward motion of said push-button, wherein the push-button switch is assembled so that when the push-button is depressed and the first inclination lever is pushed thereby, it pivots in a direction about the pivotal axle supporting said first inclination lever, and the lever return spring causes the second inclination lever to pivot about the pivotal axle supporting the second inclination lever in a direction opposite the direction in which said first inclination lever pivots, thereby causing a portion of the first inclination lever and a portion of the spring connecting mechanism of the first inclination lever to pass through the hole in the second inclination lever and separating the second inclination lever from an actuator on the switching element and causing the switching element to switch said switch further comprising a display unit disposed within said push-button for displaying switching input information inputted through said push-button, a fixing board for mounting said display unit and a switching element in said switching mechanism, and an input/output wiring flexible board coupled to said fixing board, which is electrically connected to said display unit and said switching element via said fixing board, and which extends toward the outside of the push-button switch.

* * * * *